US006662794B2

(12) United States Patent
Nagata et al.

(10) Patent No.: US 6,662,794 B2
(45) Date of Patent: Dec. 16, 2003

(54) IGNITION COIL FOR INTERNAL COMBUSTION ENGINE

(75) Inventors: Takashi Nagata, Okazaki (JP); Kazutoyo Osuka, Gamagoori (JP); Atsuyuki Konishi, Anjo (JP); Junichi Wada, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/158,227

(22) Filed: May 31, 2002

(65) Prior Publication Data

US 2002/0195092 A1 Dec. 26, 2002

(30) Foreign Application Priority Data

May 31, 2001 (JP) ..... 2001-165643
May 20, 2002 (JP) ..... 2002-145222

(51) Int. Cl.[7] ..... H01F 27/02
(52) U.S. Cl. ..... 123/634; 123/635; 336/96
(58) Field of Search ..... 123/634, 635; 336/96

(56) References Cited

U.S. PATENT DOCUMENTS 5,412,024 A * 5/1995 Okada et al. ..... 524/577
5,720,264 A 2/1998 Oosuka et al.
5,730,922 A * 3/1998 Babb et al. ..... 264/258

FOREIGN PATENT DOCUMENTS

| | | |
|---|---|---|
| JP | 8-339928 | 12/1996 |
| JP | 9-180947 | 7/1997 |
| JP | 2000-243638 | 9/2000 |

* cited by examiner

*Primary Examiner*—Erick Solis
(74) *Attorney, Agent, or Firm*—Nixon & Vanderhye P.C.

(57) ABSTRACT

An ignition coil according to the invention is an ignition coil having a case and a coil portion accommodated in the case. The case comprises a base resin whose dielectric breakdown voltage exceeds that of polyphenylene sulfide and whose spiral flow length exceeds that of polybutyrene terphthalate. As the base resin has a high fluidity, there is only a limited risk that a defect such as a weld line is caused when molding a thin case. In addition, while the thickness of the case and the electrical insulation properties are in proportion to each other, the case comprising the base resin can ensure sufficient electrical insulation properties even if the case is formed thin.

7 Claims, 1 Drawing Sheet

IGNITION COIL FOR INTERNAL COMBUSTION ENGINE

BACKGROUND OF THE INVENTION

1. Technical Field of the Invention

The present invention relates to an ignition coil, for an internal combustion engine, for generating a high voltage for application to a spark plug of the internal combustion engine.

2. Description of the Related Prior Art

An ignition coil for an internal combustion engine (hereinafter, simply referred to as an "ignition coil") is a device for generating a spark in a gap of a spark plug by generating a high voltage through a mutual induction action. There are various types of ignition coils. For example, an ignition coil of a stick type that is adapted to be mounted in a plug hole has a rod-like core, a cylindrical secondary spool placed on an outer circumference side of the core, a secondary coil wound around the secondary spool, a cylindrical primary spool placed on an outer circumference side of the secondary coil, and a primary coil wound around the primary spool. Namely, the core, secondary spool, secondary coil, primary spool and primary coil are disposed concentrically, in that order, from the inside of the ignition coil. These constituent members are accommodated within a hollow cylindrical case. In addition, a resin insulating material is filled in the case in order to secure the electrical insulation properties of the respective constituent members accommodated within the case.

Thus, disposed within the interior of the case are components such as the primary and secondary coils which carry high voltages. On the other hand, disposed outside the case are a plug hole, a cylinder head and a vehicle frame. However, these members disposed outside the case carry relatively low voltage. Consequently, a base resin for forming the case needs to withstand a potential difference between the inside and outside of the case so that no electrical conduction is established therebetween. Conventionally, due to this, base resins for forming the case are required to have high electrical insulation properties. With a view to satisfying the requirement, polybutylene terephthalate (PBT), polyphenylene sulfide (PPS) and the like have been used as base resins for forming the case.

Incidentally, in recent years, there has been a strong demand for miniaturized ignition coils and, in particular, for those having smaller diameters. Here, making the case thinner can be taken as one of means for making ignition coils with small diameters. However, the electrical insulation properties are in proportion to the thickness of the case. Therefore, making the case thinner directly leads to a reduction in electrical insulation properties. Due to this, with a conventional case using PPS as the base resin, in the event that the thickness of the case is reduced, it is difficult to ensure the electrical insulation properties thereof and there is a risk that a dielectric breakdown occurs between the inside and outside of the case.

In addition, the case is prepared through resin molding. For example, in the event that a case is prepared through injection molding, molten resin, which is heated to be fluidized within a cylinder, is injected under a high pressure into a cavity in a mold and is then cooled to be set, whereby a case is prepared. Here, when attempting to mold a thin case, the width of portions of the mold cavity which correspond to case walls naturally becomes narrow. In order to allow the molten resin to be distributed to every corner of the interior of the narrow cavity, the base resin for forming the case needs to have high fluidity. In this respect, since PBT has a low fluidity, in the event that this resin is used as the base resin for the case, there is a risk that a defect such as a weld line may be generated. This then leads to a risk that a dielectric breakdown may occur at this defect portion, so that the case cannot ensure the desired electrical insulation properties.

Namely, PPS is insufficient in terms of the dielectric breakdown voltage performance, while PBT is insufficient in terms of fluidity. No resin has been found which can satisfy the both requirements.

SUMMARY OF THE INVENTION

An ignition coil according to the invention was made in view of the problem. An object of the invention is to provide an ignition coil of a reduced diameter having a case which is superior in electrical insulation properties and small in thickness.

With a view to attaining the object, according to the invention, there is provided an ignition coil having a case and a coil portion accommodated within the case, wherein the case comprises a base resin whose dielectric breakdown voltage exceeds that of polyphenylene sulfide and whose spiral flow length exceeds that of polybutylene terephthalate. In addition, more preferably, the case comprises a base resin whose dielectric breakdown voltage is equal to or exceeds that of polybutylene terephthalate and whose spiral flow length is equal to or exceeds that of polyphenylene sulfide.

Namely, according to the ignition coil of the invention, the case is formed from a base resin having both a dielectric breakdown voltage which exceeds that of PPS and a spiral flow length which exceeds that of PBT. More preferably, the case is formed from a base resin which has both a dielectric breakdown voltage which is equal to or exceeds that of PBT and a spiral flow length which is equal to or exceeds that of PPS.

Here, the dielectric breakdown voltage means a voltage at which the electric insulation of the case fails. The higher the dielectric breakdown voltage, the better the electrical insulation properties are. In addition, the spiral flow length means the overall length of the spiral of a molded article when the molded article whose configuration resembles a spiral mosquito-repellent incense is prepared by injecting a base resin in a molten condition into a spiral groove or the flow distance of the resin along the spiral groove. The longer the spiral flow length, the better the fluidity of the resin is.

The base resin for forming the case of the ignition coil of the invention has a long spiral flow length and a high fluidity. Owing to this, it is easy to mold a thin case. In addition, when molding, there is only a limited risk that a defect such as a weld line is caused. Furthermore, the base resin for forming the case of the ignition coil of the invention has a high dielectric breakdown voltage and good electrical insulation properties. Owing to this, even if the thickness of the case is reduced, there is only a limited risk that the insulation between the inside and outside of the case is broken down.

Here, the base resin may be such as to have both a dielectric breakdown voltage which exceeds that of PPS and a spiral flow length which exceeds that of PBT. Of course, it is more preferable that the base resin is such as to have both a dielectric breakdown voltage which is equal to or exceeds that of PBT and a spiral flow length which is equal to or exceeds that of PPS by improving both performances. Furthermore, the base resin preferably has, but is not limited to, a load-deflection temperature of 240 degrees C. or greater.

Here, the load-deflection temperature (the thermal deformation temperature) is measured, as is regulated in JIS (Japanese Industry Standard) K 7207-1983, by supporting a prismatic sample at two points in a heating bath and increasing the temperature of the bath while applying a predetermined bending stress at the center of the sample. In the measurement, a temperature at which the deflection of the sample reaches a predetermined amount is regarded as the load-deflection temperature. The higher the load-deflection temperature is, the higher the heat resistance of the resin is.

In many cases, the ignition coil is placed in a high-temperature environment such as in the vicinity of a cylinder. According to the construction of the invention, even in a case where the ignition coil is used in the high-temperature environment, there is only a limited risk that the case deforms due to heat.

According to the construction of the invention, while there is no particular limitation to kinds of base resins for use for the case, it is preferable to use, in particular, crystalline polystyrene (syndyotactic-polystyrene, SPS) as the base resin for the case.

Being different from a conventional non-crystalline polystyrene (PS), SPS has a construction in which benzene rings of side chains are coordinated alternately in opposite directions relative to main chains. Due to this construction, when compared to the conventional PS, SPS is largely improved in characteristics. SPS has a high dielectric breakdown voltage and a good fluidity, as well. Therefore, by using SPS as the base resin, it is possible to easily prepare a case which has a high dielectric breakdown voltage while being thin in thickness. In addition, SPS has a high load-deflection temperature. Owing to this, even in case where the ignition coil is disposed in a high-temperature environment, there is only a limited risk that the case deforms.

Furthermore, SPS has a property that a carbonized conductive track (track) is hardly formed even if the surface, where electrolysis occurs, is dirty with dust, dirt and moisture. Namely, SPS has high tracking resistance. In this respect, SPS is preferable as the base resin for forming the case of the ignition coil according to the invention.

In addition, while there is no particular limitation to places where the ignition coil is mounted, a construction is preferable in which the ignition coil is mounted in a plug hole in a cylinder. A so-called stick type ignition coil that is mounted in a plug hole is strongly demanded to have a reduced diameter. Owing to this, the ignition coil according to the invention which facilitates the reduction in thickness of the case is preferable for a stick type ignition coil.

In addition, with a view to solving the problem, according to the invention, there is provided an ignition coil having a case and a coil portion accommodated within the case, wherein the case is formed from a base resin whose dielectric breakdown voltage exceeds 15 kV/mm and whose spiral flow length exceeds 150 mm.

Here, the reason why the dielectric breakdown voltage is set to exceed 15 kV/mm is because there is a risk that the insulation of the case may be broken down, when the dielectric breakdown voltage is equal to or less than 150 kV/mm, when attempting to reduce the thickness of the case. In addition, the reason why the spiral flow length is set to exceed 150 mm is because the fluidity of the base resin becomes low with the spiral flow length being equal to or less than 150 mm and therefore it is difficult to form the case thin. In addition, with the spiral flow length being equal to or less than 150 mm, there is a risk that a defect, such as a weld line, may be caused during molding.

Preferably, the case may be formed from a base resin whose dielectric breakdown voltage is equal to or greater than 25 kV/mm and whose spiral flow length is equal to or longer than 170 mm. The reason why the dielectric breakdown voltage is set to be equal to or greater than 25 kV/mm is because the risk, that a dielectric breakdown is caused, becomes smaller with the dielectric breakdown voltage being equal to or greater than 25 kV/mm. In addition, the reason why the spiral flow length is set to be equal to or longer than 170 mm is because the fluidity of the resin becomes higher with a spiral flow length equal to or longer than 170 mm, whereby the reduction in thickness of the case is facilitated.

The invention may be understood more fully from the accompanying drawing and the following description of a preferred embodiment of the invention.

DETAILED DESCRIPTION OF A PREFERRED EMBODIMENT

Figure 1:
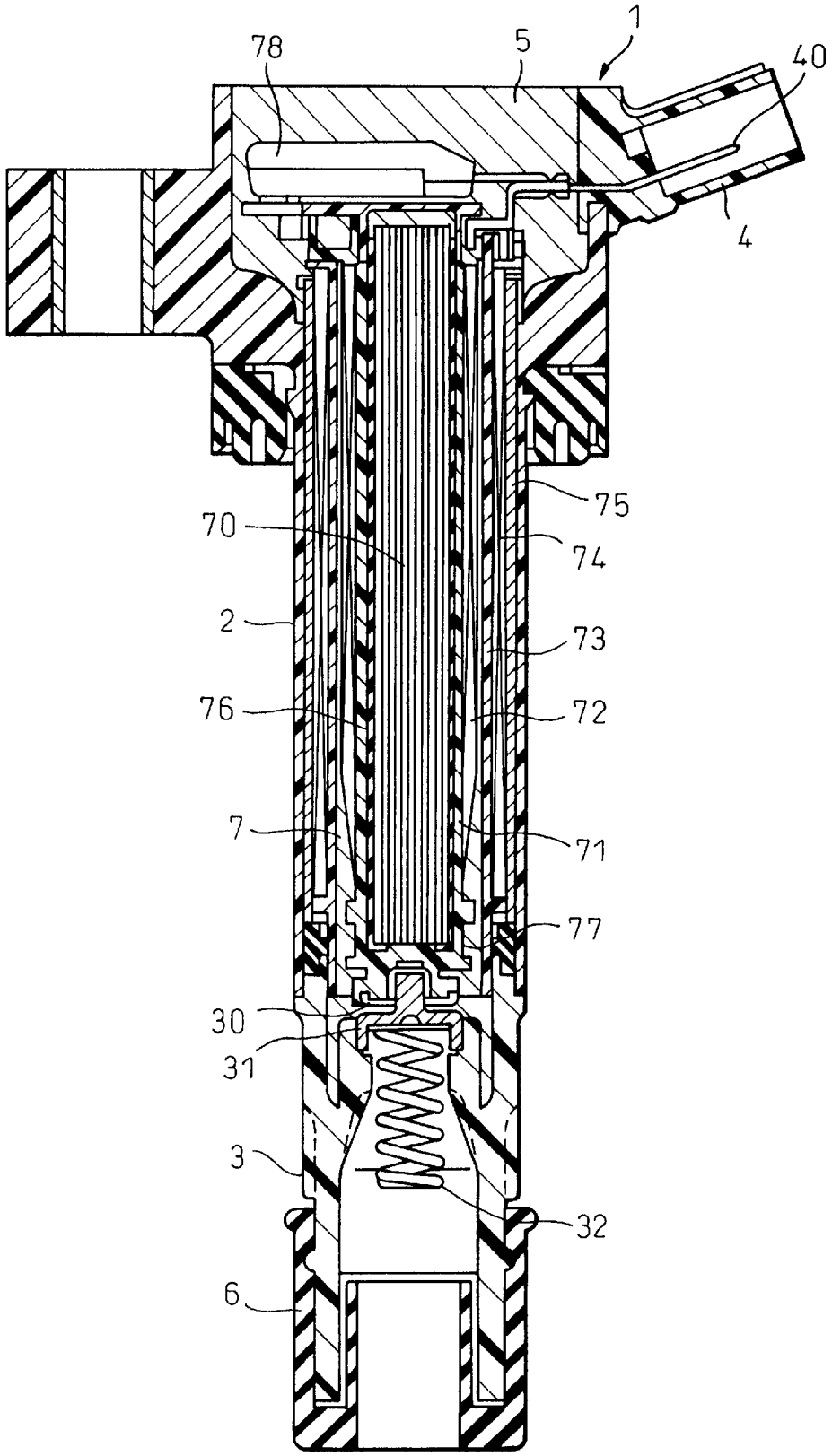
FIG. 1 is an axial sectional view of an ignition coil according to the invention.

A preferred embodiment of the invention will be described below with reference to the drawing. FIG. 1 shows an axial sectional view of an ignition coil 1 according an embodiment of the invention.

Firstly, an ignition coil 1 according to an embodiment of the invention will be descried. The ignition coil 1 is a so-called stick type ignition coil and is mounted in a plug hole formed in an upper portion of a cylinder block, not shown, for each cylinder. As shown in the figure, an outer shell of the ignition coil 1 is constituted as a case and a high-voltage tower 3. Of the two, the case 2 is made from SPS and has a cylindrical configuration. The high-voltage tower 3 is made from a resin and has a cylindrical configuration. The high-voltage tower 3 is fixed to a lower end of the case 2.

A coil portion 7 is disposed in the interior of the case 2. This coil portion 7 is constituted by a core 70, a secondary spool 71, a secondary coil 72, a primary spool 73, a primary coil 74, an outer circumferential core 75 and a rubber tube 76.

The core 70 has a rod-like configuration and is disposed on a central axis of the cylindrical case 2. The core 70 is formed by laminating sheets of silicon steel in a radial direction such that the cross section taken in a direction normal to the axis, looks like the growth rings of a tree.

The rubber tube 76 is disposed so as to cover the outer circumferential surface of the core 70 and plays the role of an insulating material.

The secondary spool 71 is disposed on an outer circumferential side of the rubber tube 76. This secondary spool 71 is made from a resin and has a bottomed cylindrical configuration. In addition, the secondary coil 72 is disposed on an outer circumferential surface of the secondary spool 71. This secondary coil 72 comprises a wire wound around the secondary spool in a stacked fashion.

The primary spool 73 is disposed on an outer circumferential side of the secondary coil 72. Similar to the secondary spool 71, the primary spool 73 also takes a bottomed cylindrical configuration. In addition, the primary coil 74 is disposed on an outer circumferential surface of the primary spool 73. This primary coil 74 is constituted by a wire wound around the primary spool 73 in a stacked fashion.

A dummy coil 77 is connected below the secondary coil 72. This dummy coil 77 is also formed by winding a wire. The dummy coil 77 electrically connects the secondary coil 72 with a terminal plate 30. The surface area of an electric connecting portion between the secondary coil 72 and the terminal plate 30 is made large by electrically connecting those two members by the dummy coil 77 instead of by a single linear wire to thereby avoid an electrostatic concentration at the electrically connecting portion.

The outer circumferential core 75 is disposed on the outside of the primary coil 74. The outer circumferential core 75 is formed by winding a thin sheet of silicon steel into a cylindrical configuration. This outer circumferential core 75 restrains the leakage of magnetic lines of force to the outside of the ignition coil 1. Note that a winding starting end and a winding terminating end of the outer circumferential core 75 are not joined together. Consequently, a slit, extending axially, is formed between the winding starting end and the winding terminating end.

A connector 4 is disposed such that it protrudes, from an upper end of the case, radially outwardly and in an upwardly inclined fashion. A terminal 40 is fixed to the connector 4 through insert molding. The terminal 40 is electrically connected to an igniter 78 disposed in an upper portion of the case 2. This igniter 78 serves to switch a primary current for supply to the primary coil 74.

A resin insulating material 5 made from an epoxy resin is filled in the interior of the case 2 to ensure the insulation between the respective members of the coil portion 7.

On the other hand, placed in the interior of the high-voltage tower 3 are the terminal plate 30, a high-voltage terminal 31 and a spring 32.

The terminal plate 30 has a disk-like configuration. A plate-like pawl portion, which is bent upwardly, is disposed at the center of the terminal plate 30. In addition, the high-voltage terminal 31 has a disk-like configuration having a convex portion at the center of an upper surface thereof, that is, a lid-like configuration of a pan. Then, the convex portion of the high-voltage terminal 31 is inserted into the pawl portion of the terminal plate 30. On the other hand, a lower portion of the high-voltage terminal 31 has a cup-like configuration. Then, an upper end of the spring 32 which is adapted to be connected to a spark plug (not shown) is inserted in an inner circumferential side of the lower portion of the cup-like configuration. Note that a cylindrical plug cap 6 made of rubber is fitted on a lower end of the high-voltage tower 3. The spark plug is press fitted in the plug cap 6.

Next, the flow of electric current through the ignition coil of the embodiment will be described. On a primary or low-voltage side, a primary electric current flows through the primary electric current terminal 40, the igniter 78 and the primary coil 74 in that order. When the primary electric current is switched by the igniter 78, a high voltage is generated on a secondary side through a mutual induction action. Due to the high voltage, sparks are generated at the plug cap 6 of the spark plug. Namely, on a secondary or high-voltage side, a secondary electric current flows through the secondary coil 72, the dummy coil 77, the terminal plate 30, the high-voltage terminal 31, the spring 32 and the spark plug in that order.

Next, the feature and effectiveness of the ignition coil 1 according to the embodiment will be described. A base resin for forming the case 2 of the ignition coil 1 according to the embodiment is SPS. As has been described, SPS has high electrical insulation properties and high fluidity when molding. Due to this, side walls of the case 2 of the ignition coil according to the embodiment are made thinner when compared to conventional cases using PBT and PPS as the base resin. However, while the case is made thinner, the insulation between the inside and outside of the case can be electrically insulated by the high electrical insulation properties possessed by SPS.

While the ignition coil according to the embodiment of the invention has been described heretofore, the mode of carrying out the invention is not limited to the embodiment as has been described. Various types of modifications and improvements, that those skilled in the art can devise, may be implemented.

For example, in the ignition coil 1 according to the embodiment, while the primary spool 73 is disposed outside and the secondary spool 71 is disposed inside, the secondary spool 71 may be disposed outside and the primary spool 73 may be disposed inside.

In addition, magnets may be constructed to be disposed at ends of the core 70 of the ignition coil according to the embodiment of the invention which have polarities opposite to the direction of magnetic flux generated when by exciting the coil. According to the construction, the voltage generated on the secondary side can be easily intensified.

In addition, while, in the ignition coil 1 according to the embodiment, the case 2 and the high-voltage tower 3 are separate from each other, they may be integrated into each other. In this case, a member incorporating the case and the high-voltage tower corresponds to the case in the invention.

In this specification, the dielectric breakdown voltage, the spiral flow length and the load-deflection temperature were measured using as an embodiment a sample using SPS (commercially available from Idemitsu Sekiyu Kagaku Co., Ltd. under a trade name of XAREC) as the base resin. In addition, the dielectric breakdown voltage, the spiral flow length and the load-deflection temperature were measured using samples made using PBT and PPS as the base resin, respectively, as Comparable Example 1 and Comparable Example 2.

(Measuring Method)

Measuring the dielectric breakdown voltage is implemented by applying voltages to the samples in a gradual fashion. Then, the lowest voltages at which the insulation of the samples is broken are measured. The lowest voltages so measured are regarded as the dielectric breakdown voltages.

Measuring the spiral flow length is implemented by mounting a mold having a spiral groove having a rectangular cross section on an injection molding machine, and by measuring the length of a spiral prepared by injecting a base resin in a molten condition from a central portion of the groove. Note that the resin temperature, the mold temperature and the injection pressure at the time of measuring remain constant. The length of the spiral is regarded as the spiral flow length.

Measuring the load-deflection temperature is implemented in accordance with a method regulated by JIS (Japanese Industry Standard) K 7207-1983. A sample is supported at two points in a heating bath, the temperature of the bath is increased while applying a certain bending stress at the center of the sample, and a temperature at which the deflection of the sample reaches a predetermined amount is measured as the load-deflection temperature.

(Results of Measurements)

The results of the measurements of the dielectric breakdown voltages, spiral flow lengths and load-deflection tem peratures of the embodiment and the comparable examples are shown in Table 1 below.

TABLE 1

| | Embodiment | Comparable Example 1 | Comparable Example 2 |
|---|---|---|---|
| Base Resin | SPS | PBT | PPS |
| Dielectric Breakdown Voltage | Good | Ordinary | Bad |
| Spiral Flow Length | Good | Bad | Ordinary |
| Load-Deflection Temperature (Degrees C.) | 250 | 220 | 270 |

As shown in Table 1, it can be seen that the embodiment has a higher dielectric breakdown voltage than those of the comparable examples 1 and 2. In addition, it can be seen that the embodiment has a longer spiral flow length than those of the comparable examples 1 and 2. Furthermore, it can be seen that the embodiment has a load-deflection temperature of 250 degrees C., and it can be seen that the embodiment has a sufficient heat resistance as the base resin for the case.

In addition, the actually measured values resulting from the measurement of the embodiment and the comparable examples with respect to the spiral flow length are shown in table 2.

TABLE 2

| | Embodiment | Comparable Example 2 | Comparable Example 2 |
|---|---|---|---|
| Base Resin | SPS | PBT | PPS |
| Dielectric Breakdown Voltage (kV/mm) | 45 | 25 | 15 |
| Spiral Flow Length (mm) | 200 | 150 | 170 |

As is shown in Table 2, the dielectric breakdown voltage of the embodiment was 45 kV/mm. In contrast, the dielectric breakdown voltage of comparable example 1 was 25 kV/mm and the dielectric breakdown voltage of comparable example 2 was 15 kV/mm.

Additionally, the spiral flow length of the embodiment was 200 mm. In contrast, the spiral flow length of comparable example 1 was 150 mm and the spiral flow length of comparable example 2 was 170 mm.

It can be seen from Table 2 that the embodiment has both the high dielectric breakdown voltage of 45 kV/mm and the long spiral flow length of 200 mm. Namely, it is seen that the embodiment has both the high electrical insulation properties and the high fluidity. With the ignition coil according to the embodiment using as the base resin for the case, the thickness of the case can easily be reduced due to the high fluidity of the base resin. In addition, with the ignition coil according to the embodiment using as the base resin for the case, even if the thickness of the case is reduced, there is only a limited risk, that the insulation between the inside and outside of the case is broken down, due to the high electric insulation properties of the base resin.

According to the invention, it is possible to provide an ignition coil of a reduced diameter having a case which is superior in electric insulation properties and is reduced in thickness.

What is claimed is:

1. An ignition coil having a case and a coil portion accommodated in said case, wherein said case comprises a base resin whose dielectric breakdown voltage exceeds that of polyphenylene sulfide and whose spiral flow length exceeds that of polybutyrene terephthalate.

2. An ignition coil as set forth in claim 1, wherein said case has a dielectric breakdown voltage which is equal to or exceeds that of polybutyrene terephthalate and has a spiral flow length which is equal to or exceeds that of polyphenylene sulfide.

3. An ignition coil as set forth in claim 2, wherein said ignition coil is mounted in a plug hole in a cylinder.

4. An ignition coil having a case and a coil portion accommodated in said case, wherein said case comprises a base resin whose dielectric breakdown voltage exceeds that of polyphenylene sulfide and whose spiral flow length exceeds that of polybutyrene terephthalate and said base resin has a load-deflection temperature of 240 degrees C. or higher.

5. An ignition coil as set forth in claim 4, wherein said base resin is a crystalline polystyrene.

6. An ignition coil having a case, and a coil portion accommodated in said case, wherein said case comprises a base resin whose dielectric breakdown voltage exceeds 15 kV/mm and whose spiral flow length exceeds 150 mm.

7. An ignition coil as set forth in claim 6, wherein said case comprises a base resin whose dielectric breakdown voltage is equal to or exceeds 25 kV/mm and whose spiral flow length is equal to or exceeds 170 mm.

* * * * *